US007455242B2

(12) United States Patent
Aleynik

(10) Patent No.: US 7,455,242 B2
(45) Date of Patent: Nov. 25, 2008

(54) RAILWAY TRACK SYSTEM

(75) Inventor: Isaak Aleynik, Sioux City, IA (US)

(73) Assignee: A&A Technologies, Sioux, IA (US)

( * ) Notice: Subject to any disclaimer, the term of this patent is extended or adjusted under 35 U.S.C. 154(b) by 37 days.

(21) Appl. No.: 11/190,650

(22) Filed: Jul. 27, 2005

(65) Prior Publication Data

US 2007/0023538 A1 Feb. 1, 2007

(51) Int. Cl.
*E01B 5/00* (2006.01)
*C21D 9/04* (2006.01)
*B61B 17/00* (2006.01)

(52) U.S. Cl. ..... 238/122; 148/581; 295/31.1

(58) Field of Classification Search ..... 238/121, 238/122, 123, 125
See application file for complete search history.

(56) References Cited

U.S. PATENT DOCUMENTS 2,178,947 A * 11/1939 Brinkman ..... 238/122
5,295,624 A * 3/1994 Ziethen et al. ..... 238/125
5,419,490 A * 5/1995 Testart et al. ..... 238/125
6,170,755 B1 * 1/2001 Schifferl ..... 238/125

* cited by examiner

*Primary Examiner*—S. Joseph Morano
*Assistant Examiner*—Robert J McCarry, Jr.

(57) ABSTRACT

A railway system has a pre-determined profile of contact surfaces between the rail and the wheel rolling along the rail. The length of the contact surface is determined based on the value of the convex-to convex or flat-to-convex contacting running surface of the rail and rolling surface of the wheel. Improved profile allows to significantly decrease contact stress loads and extend useful life of the railway system.

11 Claims, 7 Drawing Sheets

RAILWAY TRACK SYSTEM

BACKGROUND OF THE INVENTION

This invention relates to the railway art and, more particularly, to improved configuration of a railway truck wheel and rails.

In the railway art, the structure of railway trucks with wheelsets, which engage laterally spaced rails has been standardized to facilitate railway transportation within the railway system. The defined standards provide for most efficient profiles of the mutually engaged surfaces of the wheels and rails, while taking into consideration allowable contact and deformation forces acting on the contact surfaces during operation. It is well known that efficient profiles can significantly reduce friction and wear between the rail gage surfaces and the flanges of the wheels running on the rails. Proper rail gage surface and wheel profile can reduce operating costs and extend rail and wheel service life.

Despite recognition of the problem, the industry oftentimes fails to design the most efficient profile configuration. Conventionally, contact stress calculations are conducted using the Hertz Theory, which takes into consideration contact forces between adjoining bodies. Contact stresses are due to weight, driving forces and other types of unusual, mainly dynamic, forces. A simple model calculation based on the Hertz Theory evaluates the effect of the weight only. Moreover, the Hertz Theory can be used only with perfectly elastic bodies under normal loads since Hertz calculated only the surface stresses.

For many years, engineers have been heavily relying on the Hertz Theory for stress calculations. Even more complicated theories consider the driving and other forces as a percentage of weight. Some researches evaluate subsurface stresses considering the contact between two spheres or two cylinders, which creates a circular or rectangular contact area, respectively. With these shapes, the contact area dimensions are determined analytically, by solving simple equations. However, the rail/wheel contact is more complex, it is elliptic due to the interaction between two curved bodies positioned in perpendicular planes. Elliptical contact is the contact between two bodies having different radii of curvature, such as the contact between a rail head and a wheel or wheel rim.

The industry recognizes that many rolling surface defects are due to the failure of the surface to withstand applied loads. The strength depends on the surface hardness, which can be determined by experiments under controlled conditions. Evaluating the loads is more complex and presents a considerable challenge for contact researchers, who attempt to evaluate the stress field inside elastic rolling bodies with an elliptic area of contact.

Additional problems encountered with conventional railway systems include the tendency for the wheel sets to traverse curves in a non-radial orientation and cause the wheel flange to rub against the rail. Such rubbing contact and wheel sliding result in undesirably high wheel and rail wear; when the flange rubs against the side of the rail, the wheel may produce a tendency to climb the rail and cause a derailment. In addition, improper wheel set tracking in curves may result in track misalignment.

A further problem is the possibility of design variations occasioned by imprecise manufacture, assembly, as well as railway deformation. Even further, the designers are often required to theoretically calculate most beneficial contact stresses, without taking into consideration specific dimensions of contact surfaces, precise shapes and site conditions.

The present invention contemplates elimination of drawbacks associated with the prior art and provision of the wheel/rail design, which reduces contact stresses regardless of the particular country's allowed norms and sizes governing rail and wheel specifications.

SUMMARY OF THE INVENTION

It is, therefore, an object of the present invention to provide a railway system, which allows to substantially reduce wheel/rail contact stresses.

It is another object of the present invention to provide a railway system, which can be used on railroads and other areas requiring reduction in contact stresses between rails and wheels riding on the them, while making the railway system not dependent on the degree of allowed deviations and relative sizes of the wheel and rail.

These and other objects of the present invention are achieved through a provision of a wheel and rail head structures, which minimize the contact stresses in a wheel ridge and rail head. If the wheel and the rail head have convex to flat contact surfaces, the rolling surfaces are configured with predetermined values in the size of the contact surface considering inevitable deflection from radial alignment between the wheel and the rail. The discreet length of the contact surfaces preferably have a pre-determined relationship to the radius of convex contact surface of the wheel and straight surface of the rail, as well as the value of deflection from alignment ($\phi$). This relationship can be expressed as $Lr = 4R\phi$. If the defining surface of the rail running surface is also convex and has the same size as the rail contact surface (that is two convex surfaces in cross-section at the wheel ridge and rail head), then the discreet length of the contact surface is expressed as $Lr = 2R\phi$.

In both cases, R must correspond to $$\frac{2b}{Lr} = 0.45 \text{ to } 0.55$$

It is assumed, for the purposes of this invention that the acceptable misalignment does not exceed 2-3 degrees.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
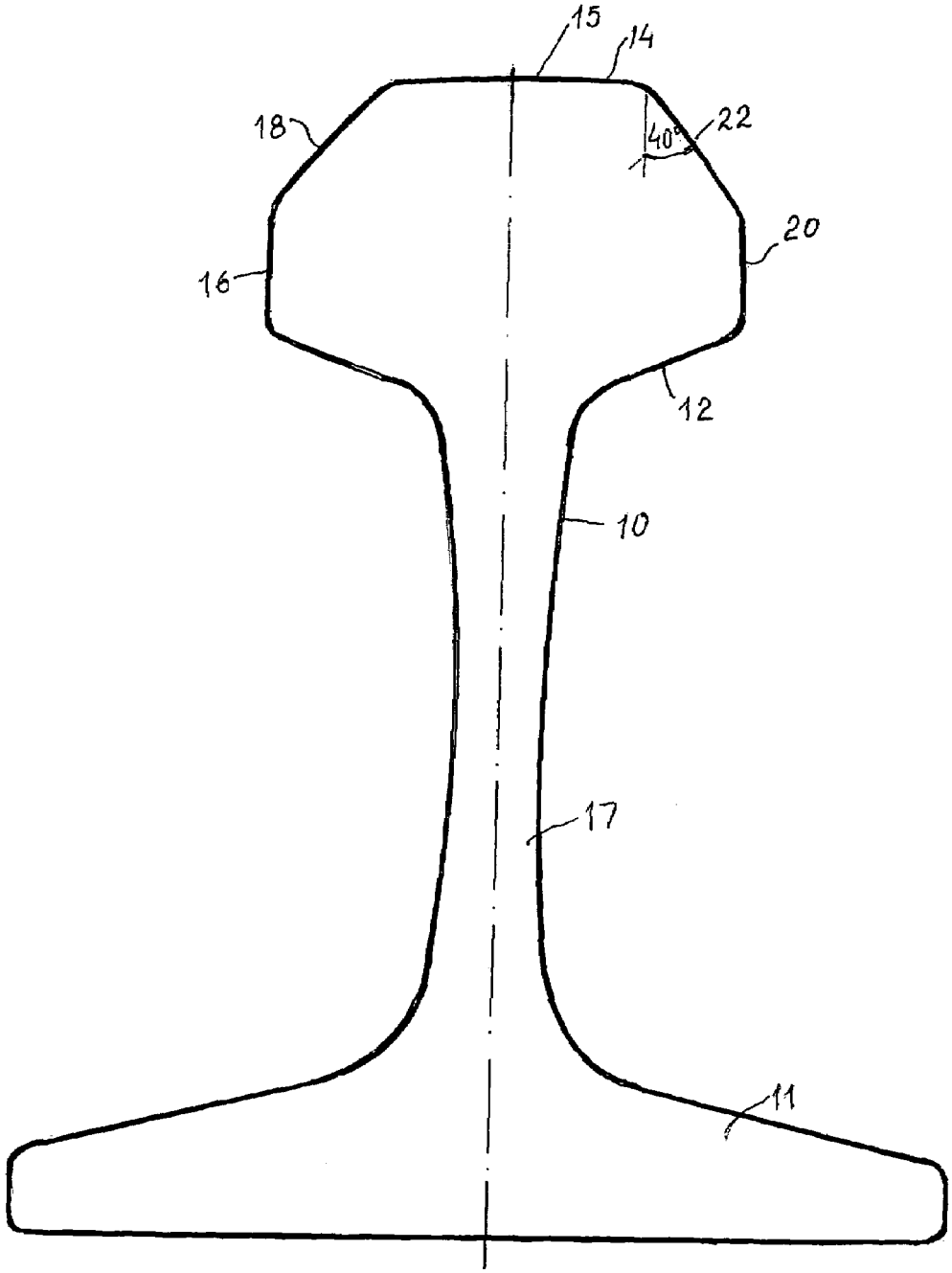
FIG. 1 is a cross sectional view of the rail illustrating configuration in accordance with the first embodiment of the present invention when two convex surfaces contact.

The present invention provides for the rail/wheel design, which takes into consideration the elliptical characteristics of the contact surfaces. The contact stresses may be calculated based on my theory of elliptical contact stresses described in detail in my U.S. Pat. No. 5,810,482 issued on Sep. 22, 1998 for "Roller Bearing." However, the problem of reduction of contact stresses in the wheel/rail interaction presents additional considerations, as described below.

FIGS. 1-6 illustrate the profile of the rail/wheel contact surfaces under most difficult work conditions, when the rail car moves along a curve. In the description, which follows, it is assumed that the outside rail is elevated to a pre-determined height as is known in the art, the axial loading is pre-determined as Pp, elliptical contact surface with large half-axis (along the rail) is designated as "a" and smaller half-axis (across the rail)—as "b." Lr is the length of the rolling contact surface in misalignment (deflection) plane; R is the elliptic radius of convex contact surface in the area of contact, and 2b is the size of the contact stress surface in misalignment plane $\phi$.

Turning now to the drawings in more detail, numeral 10 designates a rail according to the first embodiment of the present invention designed for use when a convex surface of the rail head makes contact with a convex surface of the wheel. The rail 10 has a generally frustoconical configuration, with a plurality of outside facets or surfaces. The rail 10 comprises a base 11, a rail head 12 with a tread, or running surface 14, which is outwardly convex, and a connecting web 17. The rail head 12 has a lower inner surface 16, an upper inner surface 18, an outer lower surface 20 and an outer upper surface 22. In this embodiment, the upper surfaces 18 and 22 are oriented at about 40 degrees to the tread surface 14.

A wheel engaging the rail 10 is likely to contact two critical surfaces: the tread 14 and one of the side surfaces depending on whether the wheel occupies left or right position in a wheelset comprised of two opposing wheels. For the purposes of illustration only, it is assumed that the inner surface 22 may become a contact surface when the train moves on a curved railway.

When traversing a curve (whether superelevated or flat), a train's center of gravity takes on a horizontal component owing to the centripetal force. This horizontal component has an influence on where the center of gravity line intersects the suspension point plane. The present invention allows stabilizing movement of the train going round a curve notwithstanding the effects of the wheel flanges interfacing with rail. The present invention also decreases the effective shift of the intersection arising from any excessive canting of the track or any sideplay in either coupled wheels or bogies.

As the tests show, only the center part 15 of the convex tread 14 contacts the wheel and the same is true for the inner surface 22. The discreet length of the contact surfaces 15 and 22 will preferably have a pre-determined relationship to the radii of convex contact surfaces of the wheel and rail, and the size of the contact surface in misalignment plane $\phi$. With a pre-determined load Pp, this relationship can be expressed by the following equation:

$$Lr=2R\phi$$

where

Lr is the effective length of the rail contact surface,

R is the radius of the curved contact portion of the wheel tread, and

Phi is the angle of misalignment of the symmetrical axis determined as an angle between tangent lines applied to the wheel and rail at a point of contact.

The angle of misalignment value (assumed to be 2°) can be expressed as $\phi=2°=0.035$ radian. The same relationship between the convex contact surfaces will remain if the angle of misalignment is 3°. It is not anticipated that the misalignment value will exceed 3°.

In the preferred embodiment, $$\frac{2b}{Lr} = 0.45 \text{ to } 0.55,$$

where "b" is half-width of the contact area (across the length of the rail). In the most preferred embodiment, the width of the contact area has the ratio of 0.5.

In one of the exemplary embodiments, the radius of the contact surfaces 18 and 22 is 15", the radius of the convex contact portion 15 is approximately 15" (more precisely 14.583"). These radii of curvature are presented for illustration purposes only and can be changed depending on the size of the rail and the wheel.

Figure 2:
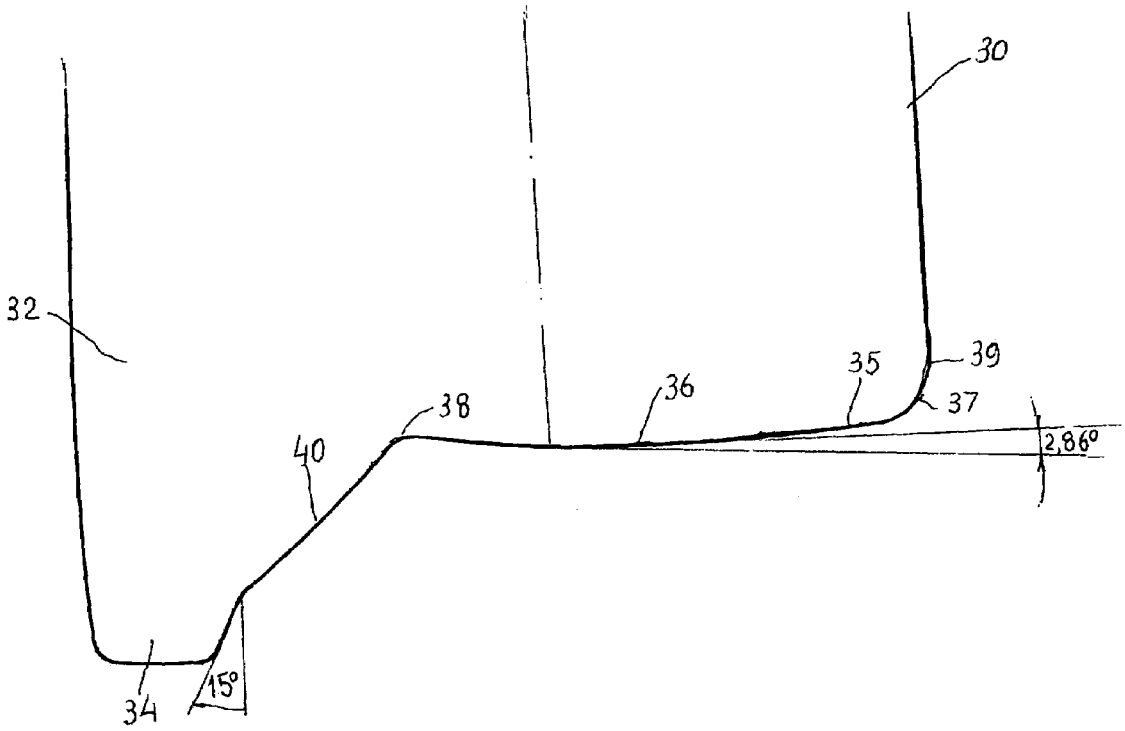
FIG. 2 is a cross sectional detail view of a part of a wheel adapted to roll on the rail of the first embodiment.

Turning now to FIG. 2, a fragmentary profile of wheel having convex contact surfaces is illustrated. The wheel profile of the present invention is designed to provide the dynamic stability of the train car or bogey at various speeds throughout its operating speed range, as well as reduce undesirable lateral oscillations known as "wheelset hunting." Hunting may result in derailment when the speed of the moving train overcomes the wheel flange stabilizing force.

The wheel/rail profile interface of the instant invention takes into consideration train stability when negotiating track curves. This curving ability is determined primarily by the ability of the opposing wheels of wheelsets to follow the track curves. Optimally, the wheels roll on the rail head in the track curves without any contact between the wheel flanges and the rails. However, in reality the oscillation force causes the wheels to move away from a strictly radial position. As shown in the drawings, more specifically in FIG. 2, 3, and 5-7, a wheel 30 of the instant invention has inwardly sloping planar and curved bearing surfaces, which contact the rail 10.

To maintain a rolling engagement with a rail, the wheel 30 has a circumferential flange portion 32, which extends along one of the sides of the rail head when the wheel 30 rolls along the rail. The flange portion 32 protrudes downward from the side of the train wheel and extends over the lateral side of a train track. The flange portion 32 provides steering when rail curve exceeds capability of treads to steer without flange contact. Some designs of the rail wheel provide for a downwardly extending part 34, which is designed to increase safety and prevent derailment. In some designs, the part 34 extends at 15° to the vertical axis of the wheel 30.

Normally, the main contact surface is downwardly facing tread section 36, which is outwardly convex, so that only the most outwardly extending part of the wheel 30 rolls on the rail 10. The wheel tread section 36 is the major load bearing surface that supports the train wheels on a train track. The surface 36 and its cross-sectional radius are inclined in relation to the rail at a standard relationship of 1:20. The surface 36 continues as a transition concave part 38, or fillet which extends between the contact surface 36 and a convex surface 40 of the wheel flange. The fillet 38 extends upward along a field side of the flange providing transition to the wheel tread section. The fillet 38 may have a radius of approximately 0.035". In this embodiment, the side surface 40 is outwardly convex, although in some embodiments this surface may be straight. A field side 35 of the wheel 30 includes a bevel 35 that extends up to point 39.

The wheel side surface 40 may come into contact with the surfaces 18 or 22 (depending on whether the wheel 30 occupies left or right position in a wheelset), as a result of which the surface 40, at its most outwardly extending part, will become the contact surface in the wheel-rail relationship. Consequently, to ensure the most beneficial and safe contact between the surfaces 36 and 40 with the rail tread and rail side surface, with a given load of Pp, the radius of the contact part is pre-determined according to the preferred relationship, which can be expressed as follows:

$$Lr=2R\phi,$$

where

Lr is the effective length of the rail contact surface;

R is the radius of the curved contact portion of the wheel tread, and

Phi is the angle of vertical misalignment of the symmetrical axis in relation to the normal line of the wheel rolling surface incline.

It is also preferred that the contact surface has a certain ratio with the effective length of the contact. This relationship can be expressed as follows:

$$\frac{2b}{Lr} = 0.45 \text{ to } 0.55,$$

with the most preferred ratio being 0.5.

With an anticipated misalignment of about 2°, the angle phi can be expressed as $\phi=2°=0.035$ radian.

Figure 3:
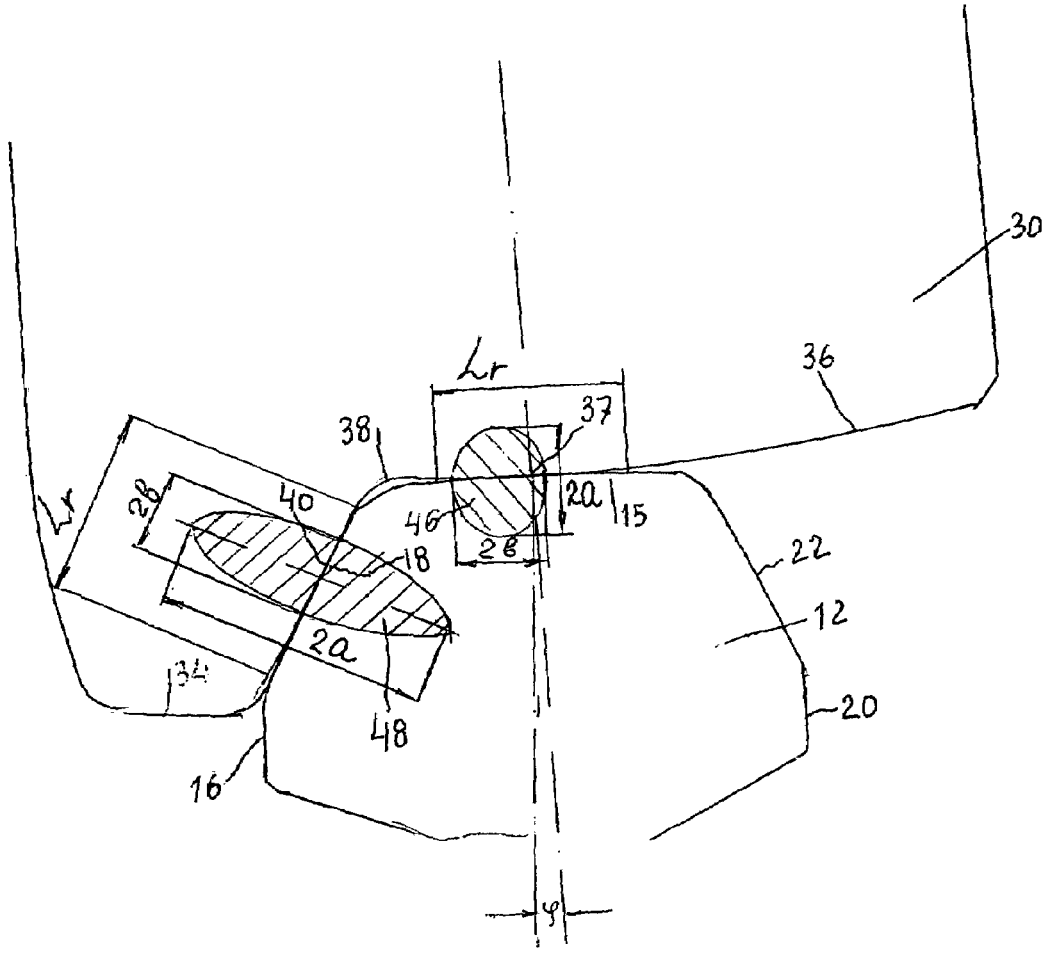
FIG. 3 is a fragmentary sectional view of a rail car wheel supported on a rail which is shown in section on a plane perpendicular to the axis of the rail using a pentahedral profile of the rail head and convex surfaces of the wheel.

FIG. 3 illustrates a wheel/rail position when both wheel and rail have convex contact surfaces. Here, the rail head 12 supports the wheel 30, with the contact between surfaces 15 and 37 of the rail head 12 and wheel 30, respectively. The shaded area 46 illustrates the part of the contact where stresses are greatest. The vertical size 2*a* of the stress area 46 area is the sum of the height of elliptical contact surfaces. The base and the web of the rail are not shown.

The second contact area between the surfaces 18 and 40 has the area of significant stress 48, which is located at the junction between the convex surfaces 18 and 40 when the train moves along a curved rail track. The area 48 is shaded, similarly to the area 46. As can be seen in the drawing, the surface 38 does not contact the rail head 12; however, the most outwardly extending portions of the convex surfaces 15, 37 and 18, 40 come into contact during normal operation of the railway.

Figure 4:
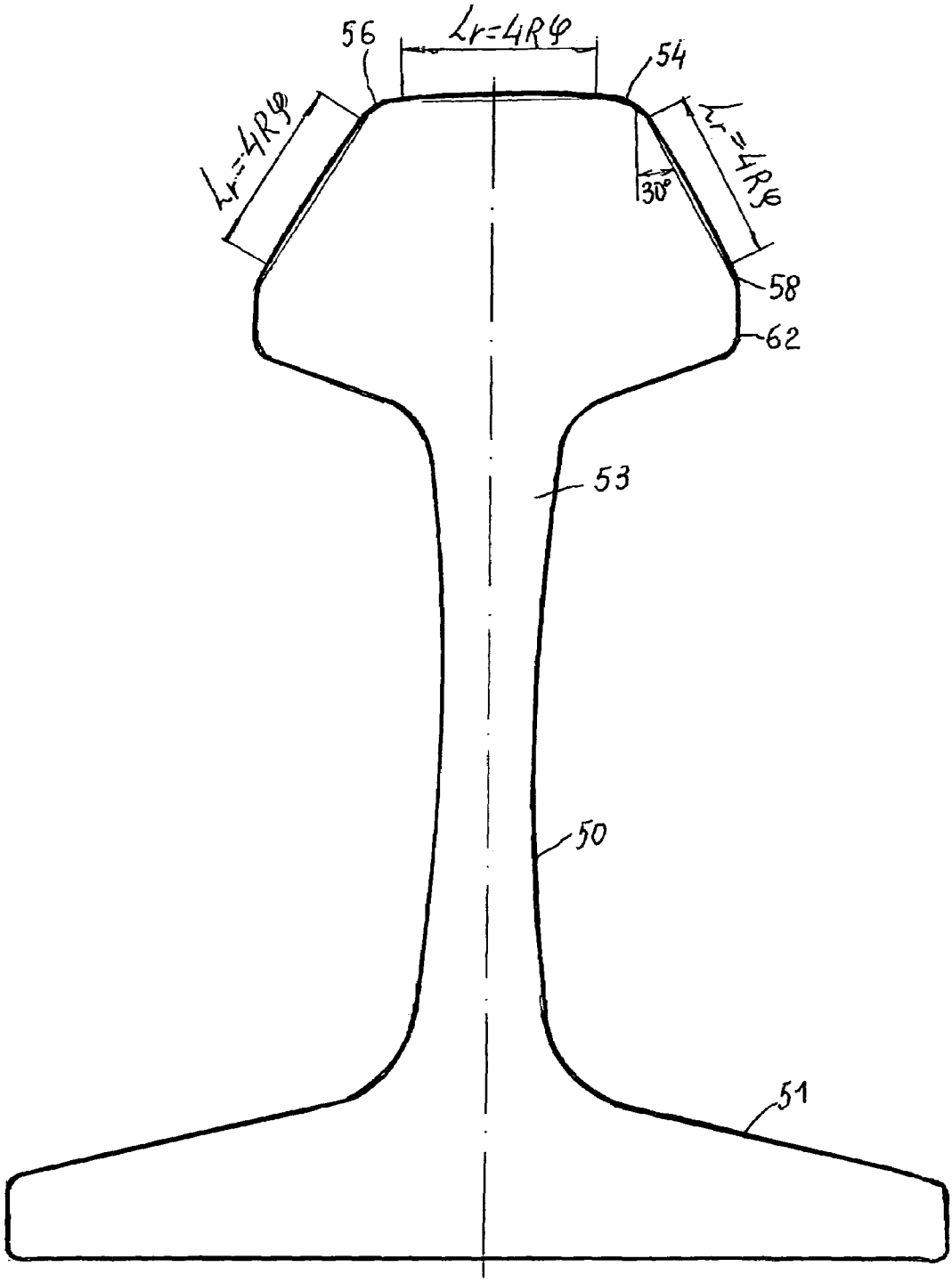
FIG. 4 is a cross sectional view of the rail in accordance with the second embodiment of the present invention illustrating a suitable configuration when the contact with the wheel is along straight lines.

FIG. 4 illustrates a second embodiment of the rail in accordance with the present invention particularly adapted for situations, when flat surface of the wheel and rail make their contact. The rail 50 has a base 51, a rail head 52 with a top running surface, or track 54, and a connecting web 53. The rail head 52, similarly to the railhead 12, has a generally frustoconical configuration, with a pair of upper sloping surfaces 56, 58, and lower sloping surfaces 60, 62. Depending on whether the rail is an inside or an outside rail, either side slope 56 or side slope 58 is contacted by a wheel rim. In FIG. 4, the angle between a vertical axis of the rail head 52 and the sides 56 or 58 is 30 degrees, although other configurations are within the rail designer's choice.

Since the surfaces 54, 56 and 58 are formed by formed by straight lines, the area of contact with a wheel is larger than the area of contact between two convex surfaces. It is preferred that the radial dimension of the wheel's convex surface and a discreet length of the surface contact have a pre-determined relationship to the angle of the rail's deviation from a strictly symmetrical vertical axis, and that the contact surface has a certain ratio with the effective length of the contact. This relationship can be expressed by the following equation:

$$Lr=4R\phi,$$

where

Lr is the effective length of the rail contact surface,

R is the radius of the curved contact portion of the wheel tread, and

Phi is the angle of vertical misalignment of the symmetrical axis in relation to the normal line of the wheel rolling surface incline.

It is also preferred that the contact surface width has a certain ratio with respect to the effective length of the contact. This relationship can be expressed as follows:

$$\frac{2b}{Lr} = 0.45 \text{ to } 0.55$$

with the most preferred ratio being 0.5.

Figure 5:
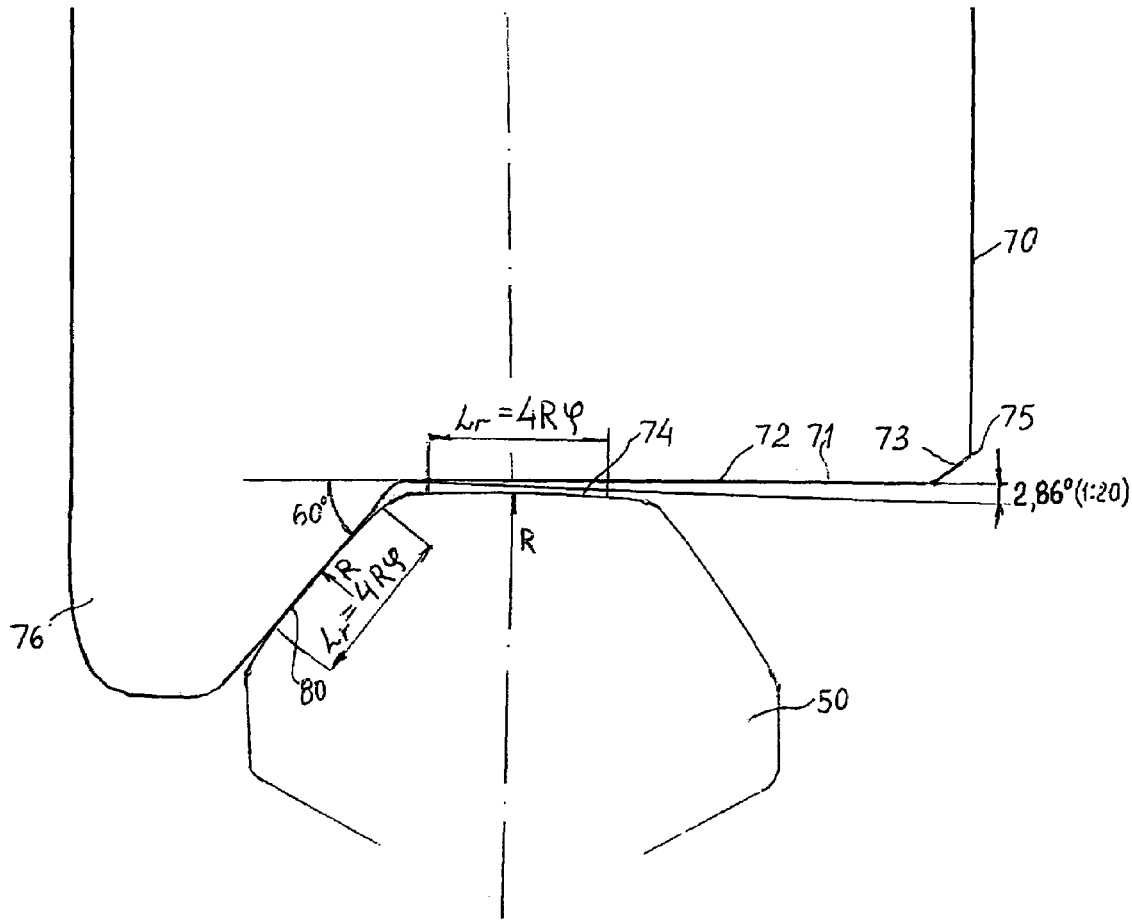
FIG. 5 is a cross-sectional detail view of the wheel adapted to roll on the rail of the second embodiment.

FIG. 5 illustrates another embodiment of a wheel, which can be used with either rail of the first embodiment or of the second embodiment. The wheel 70 has a convex downwardly facing rolling surface 72, a part 74 of which contacts a rail head. A field side 71 has a bevel surface 73, which extends to a point 75. A circumferential flange 76 extends from one side of the wheel 70. The flange 76 has a surface 78, a convex part 80 of which can come into contact with a rail. If desired, the angle between the surfaces 72 and 78 can be established at 60 degrees. The surface 72 and its cross-sectional radius are inclined in relation to the rail 50 (partially shown in FIG. 5) at a standard relationship of 1:20.

If the wheel 70 is rolling along a rail that has convex contact surfaces, the relationship between the radial dimension of the wheel's convex surfaces 72, 78 and a discreet length of the surface contact have a pre-determined relationship to the angle of the rail's deviation from a strictly symmetrical vertical axis. This relationship can be expressed as $Lr=2R\phi$, as described above. If the wheel 70 is used for rolling on a rail with flat contact surfaces the relationship, in the preferred embodiment can be expressed as $Lr=4R\phi$.

The ratio of the contact surface 74, 80 to the effective length of the contact is the same whether the rail head convex or straight surfaces, that is $$\frac{2b}{Lr} = 0.45 \text{ to } 0.55$$

With an anticipated misalignment of about 2°, the angle phi can be expressed as $\phi=2°=0.035$ radian.

Figure 6:
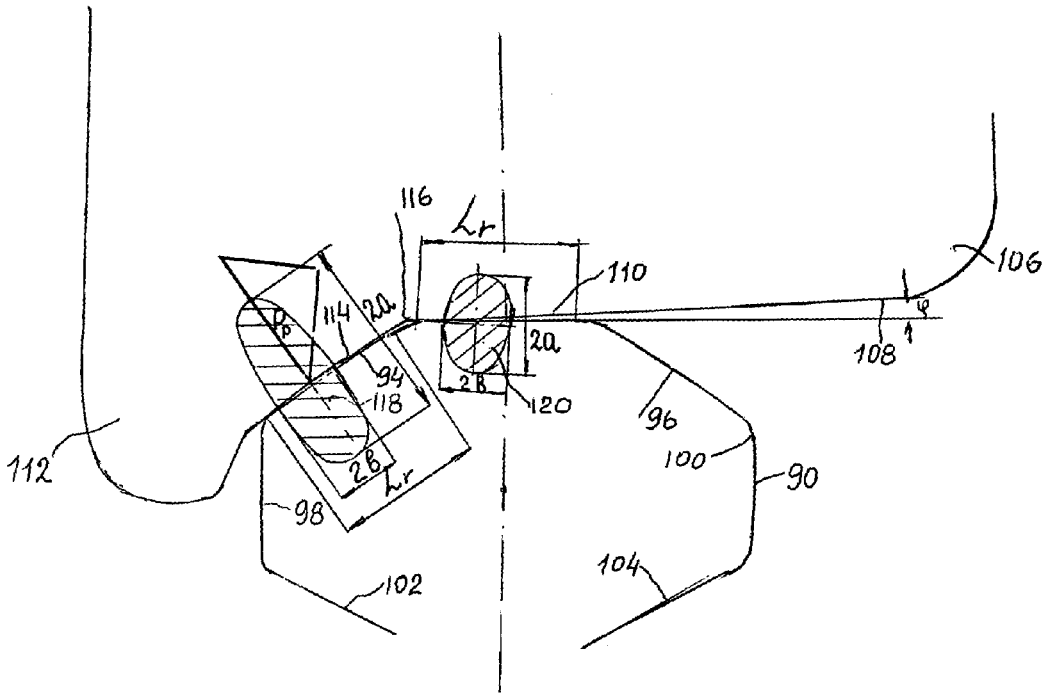
FIG. 6 is a fragmentary section view illustrating the wheel/rail interface of the system of the present invention using a heptagonal profile of the rail head and trihedral profile of the rail.
Figure 7:
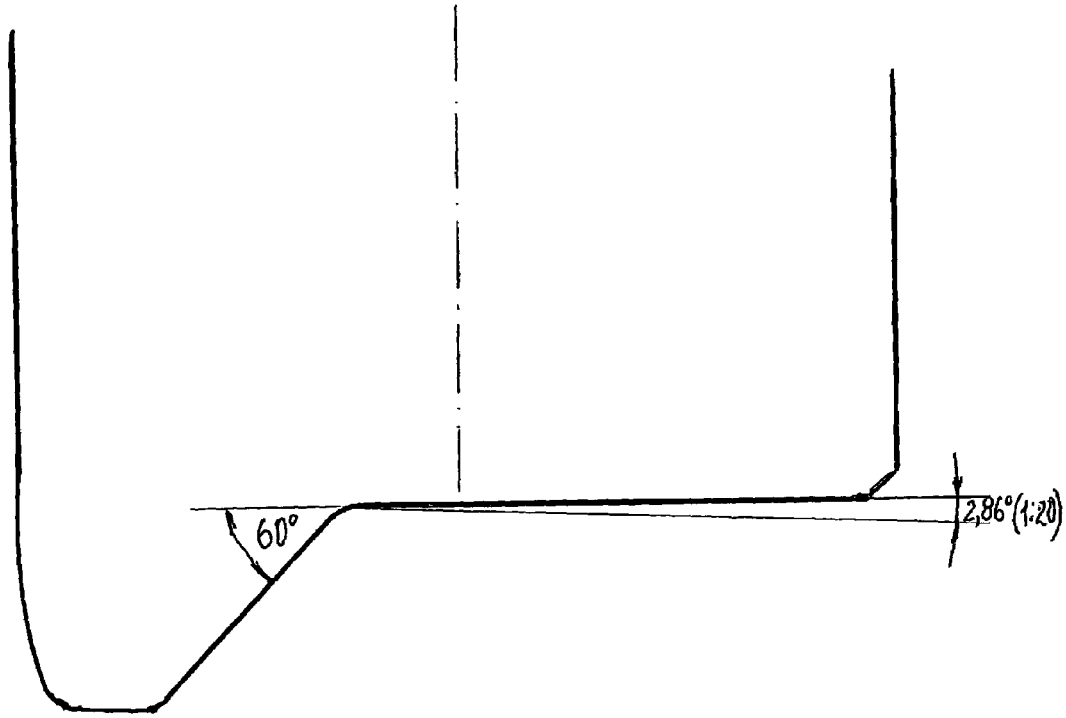
FIG. 7 is a cross sectional detail view of a part of a wheel adapted to roll on the rail of the second embodiment.

FIG. 6 shows a wheel/rail contact with the rail having a slightly different profile. In this embodiment, a rail head 90 having a heptagonal profile is in contact with a wheel having a trihedral profile. The rail head 90 has an upper tread 92, a pair of upper sloping surfaces 94, 96, pair of side surfaces 98, 100 and a pair of inwardly sloping bottom surfaces 102, 104. In FIG. 6, the contact surfaces 118, 120 are shaded and slightly turned. The rail base and the base are not shown.

A wheel 106 has a rolling surface 108 and a convex contact area (wheel ridge) 110. A downwardly extending circumferential flange 112 has a convex area 114, and an inwardly concave intermediate surface 116. The projection of the force Pp on the surface 118 equals zero. Similarly to the embodiment shown in FIG. 3, the vertical size 2*a* of the stress areas 118 and 120 is the sum of elliptical contact surfaces, and 2*b* is width of the contact area (across the length of the rail). The relationship between the radial dimension of the wheel's convex surfaces 110, 114 and a discreet length of the surface contact have a pre-determined relationship to the angle of the rail's deviation from the symmetrical vertical axis. This relationship can be expressed as $Lr=2R\phi$, as described above.

Applying the above design criteria to an example of a wheel/rail profile, and assuming that the axial load is 39 tons, vertical load per wheel Pa=19.5 tons, horizontal load per wheel Sa=15.6 tons, elevation of the outside wheel H=6.693", it is determined that the calculated diameter of the wheel about the rolling surface D=38". The calculated load per wheel/side surface of the rail Pp=25 tons. The allowable deflection using straight contact lines $\phi=0.026$ radian (1.5°) and, if using convex contact $\phi=0.035$ radian (2°). From the above, the convex radius R=0.6215 miles. Of course, those skilled in the art will readily appreciate that the above calculations are purely exemplary and will differ depending on the loads and angle of deflection.

The wheel/rail design of the present invention provides not only the least contact stress on the rail head and wheel, but also ensures constant contact pressure when contact is interrupted due to misalignment $\phi$ in cross section due to acceptable errors in manufacture and use of the railway. Additionally, the rolling resistance is decreased; the railway service life and safety are improved. The present invention does not depend for its success on a particular system of measurements. Whether the units are expressed in the metric, or non-metric units, as long as the desired ratio of relationship between the width of the contact surface taken across longitudinal extension of the rail structure and an effective length of the contact surface fits within the range of 0.45 to 0.55, wherein the dividend is the width of the contact surface taken across longitudinal extension of the rail structure "2*b*" and the divisor is the effective length of the contact surface "Lr," the present invention works in either metric or American systems of measurements. This range allows a rail designer to devise a rail structure and the wheel structure within the parameters that result in a substantially reduced wear of the metal during misalignment of the wheel in relation to the rails' vertical axis. It is such misalignment during the train's motion that results in the wear and fatigue of the metal. The instant application addresses two distinct dispositions of the contact surface on the rail head and the wheel:

(1) in the absence on the lateral forces, the contact surface is located on the horizontally oriented (top) face(s) of the rail head and the horizontally oriented (bottom) face of the wheel, (2) when the lateral forces are present, the contact surface is located on the outer inclined lateral face of the rail head and on the downwardly extending flange portion of the wheel.

The measurement criteria can also be explained as follows:

(a) The value of the width measurement 2*b* of the contact surface is fully placed within the measurement of the effective length of the contact surface Lr, and said measurement 2*b* of the contact surface accounts for 0.45÷0.55 of the measurement of the effective length of the contact surface Lr;

(b) The effective value of the length of the contact surface Lr is fully placed within the face of the rail head on which it is located, so the measurement of the effective length of the contact surface Lr is less then the length of the top face when it is located on the top face;

(c) the measurement of the value of the effective length of the contact surface Lr is less then the length of the inclined lateral face of the rail head when it is located on the inclined lateral face of the rail head.

As a further benefit, it is envisioned that the need for lubrication of the rails can be eliminated. Conventional railway systems use special devices that apply a lubricant to the wheel/rail interface from the track wayside, These flange oilers are usually provided near curves or other sections of track where the metal-to-metal contact forces between the wheel and the rail increase dramatically. The industry contends that by providing lubrication, wear phenomena such as spalling are prevented and the life of the railcar wheels is generally improved, as is the life of the track. Rolling friction is also lessened, thereby increasing fuel efficiency. The present invention envisions that a proper balance between the radius of the convex contact surfaces and the length of the contact surfaces will eliminate the need for the flange oilers, thereby increasing safety and expanding the life of the railway.

Many changes and modifications can be made in the design of the present invention without departing from the spirit thereof. I, therefore pray that my rights to the present invention be, limited only by the scope of the appended claims.

What is claimed is:

1. A railway track system, comprising:

a longitudinally extending rail structure with a rail head, said rail head including a laterally disposed running surface;

a wheel structure having a bearing surface and a wheel tread with a rolling surface configured for rolling engagement with the rail head running surface, said running surface and said rolling surface establishing a contact surface when the wheel structure contacts the running surface of the rail, said contact surface having distinct dimensions selected to fit within a range that is determined based on the relationship between width of the contact surface taken across longitudinal extension of the rail structure and an effective length of the contact surface, said range being determined as:

$$2b/Lr=.45 \text{ to } .55$$

where 2*b* is the width of the contact surface taken across longitudinal extension of the rail structure and Lr is the effective length of the contact surface; and said rolling surface has a distinct radial dimension and said contact surface has a distinct effective length determined according to:

$$Lr=4R\Phi$$

where Lr is the effective length of the contact surface, R is the radius of the convex contact portion of the wheel, and $\Phi$ is the angle of vertical misalignment from the rail's vertical axis determined as an angle between tangent lines applied to the wheel and rail at a point of contact.

2. The system of claim 1, wherein said wheel structure comprises a main body and a downwardly extending flange portion, said flange portion having an outwardly convex part.

3. The system of claim 2, wherein said rail structure has a generally conical side surface having an axis and an outwardly convex side part, said flange convex part and said rail outwardly convex side part forming a side contact surface when the flange portion contacts the side surface of the rail.

4. The system of claim 3, wherein said side contact surface has a distinct effective length determined according to:

$$Lr=2R\Phi$$

where Lr is the effective length of the side contact surface, R is radius of the outwardly convex part of the flange, and Φ is the angle of deflection from the axis of the rail's side surface determined as an angle between tangent lines applied to the wheel and rail at a point of contact.

5. The system of claim 1, wherein said running surface is defined by a flat surface and wherein said rolling surface is defined by a convex surface.

6. The system of claim 1, wherein said wheel structure comprises a main body and a downwardly extending flange portion, said flange portion having an outwardly convex part.

7. The system of claim 6, wherein said rail structure has a generally conical side surface having an axis and a substantially flat side part, said flange convex part and said rail side part forming a side contact surface having an effective length when the flange portion contacts the side surface of the rail.

8. The system of claim 7, wherein said side contact surface has a distinct effective length determined according to:

$$Lr=4R\Phi$$

where Lr is the effective length of the side contact surface, R is radius of the convex part of the flange, and Φ is the angle of deflection from the axis of the rail's side surface determined as an angle between tangent lines applied to the wheel and rail at a point of contact.

9. A profile for a railway wheel and rail, comprising:

a rail structure having a vertical axis, a base, a web and a generally conical rail head provided with a running surface;

a wheel structure having a a rolling surface for riding along the running surface of the rail head, and a flange portion extending over an edge of the rail head, said rolling surface forming a contact surface with distinct dimensions selected to fit within a range that is determined based on the relationship between width of the contact surface taken across longitudinal extension of the rail structure and an effective length of the contact surface, said range being determined as:

$$2b/Lr=.45 \text{ to } .55$$

where 2*b* is the width of the contact surface taken across longitudinal extension of the rail structure and Lr is the effective length of the contact surface; and said rolling surface has a distinct radial dimension and said contact surface has a distinct effective length determined according to:

$$Lr=4R\Phi$$

where Lr is the effective length of the contact surface, R is the radius of the convex contact portion of the wheel, and Φ is the angle of vertical misalignment from the rail's vertical axis determined as an angle between tangent lines applied to the wheel and rail at a point of contact.

10. The profile of claim 9, wherein said flange has an outwardly convex flange surface intermittently forming a side contact surface with an outwardly convex side of the rail head, and wherein the side contact surface has a discrete effective length determined according to:

$$Lr=2R\Phi$$

where Lr is the effective length of the contact surface, R is the radius of the convex contact portion of the flange, and Φ is the angle of vertical misalignment from the rail's axis determined as an angle between tangent lines applied to the wheel and rail at a point of contact.

11. The profile of claim 9, wherein said flange has an outwardly convex flange surface intermittently forming a side contact surface with the conical side of the rail head, and wherein the side contact surface has a discrete effective length determined according to:

$$Lr=4R\Phi$$

where Lr is the effective length of the contact surface, R is the radius of the convex contact portion of the flange, and Φ is the angle of vertical misalignment from the rail's axis determined as an anglebetween tangent lines applied to the wheel and rail at a point of contact.

* * * * *